US005979092A

United States Patent [19]

Liu

[11] Patent Number: 5,979,092

[45] Date of Patent: Nov. 9, 1999

[54] DRIVING SEAT OF A CRYSTAL BALL

[76] Inventor: Jack Liu, No. 3, Alley 202, Kao-Fon Rd., Hsin-Chu City, Taiwan

[21] Appl. No.: 08/974,878

[22] Filed: Nov. 20, 1997

Related U.S. Application Data

[63] Continuation-in-part of application No. 08/611,668, Mar. 6, 1996, Pat. No. 5,842,296.

[51] Int. Cl.[6] ..... G09F 19/08

[52] U.S. Cl. ..... 40/411; 40/409; 74/48; 74/665 GA

[58] Field of Search ..... 40/409, 410, 411, 40/414; 74/48, 665 GA; 446/352, 353, 357, 359, 360

[56] References Cited

U.S. PATENT DOCUMENTS 1,607,042 11/1926 Bedel et al. ..... 40/411
4,939,944 7/1990 Hou ..... 446/352 X
5,226,845 7/1993 Wu ..... 40/414 X
5,393,259 2/1995 Lee ..... 40/414 X
5,735,726 4/1998 Cohen ..... 40/414 X

*Primary Examiner*—Brian K. Green
*Attorney, Agent, or Firm*—Smith, Grambell & Russell, LLP

[57] ABSTRACT

A driving seat of a crystal ball, comprising a disk shape seat, a plurality of gears, a swing block, a restoring block, a rotary disk, and other components, wherein the long hole of the extending arm of the swing block is located on the shaft of a driven gear, the driven gear is engaged with an active gear, and the gear on the lower end of a rotary disk is engaged with a small gear on the upper end of the active gear. By this structure, when the active gear is rotated, the swing block is driven to rotate to swing forward and backward, and at the same time, the rotary disk is driven to rotate.

16 Claims, 3 Drawing Sheets

DRIVING SEAT OF A CRYSTAL BALL

RELATED APPLICATION

This application is a continuation-in-part (CIP) of U.S. patent application Ser. No. 08/611,668, filed Mar. 6, 1996, now U.S. Pat. No. 5,842,296, entitled "Crystal ball with assemble motive die set."

BACKGROUND OF THE INVENTION

The present invention relates to a driving seat of a crystal ball, and especially, to a driving seat, the active gear of which may drive a plurality of components simultaneously so that the decoration may present many dynamic phenomena.

DESCRIPTION OF THE PRIOR ART

In the prior decoration having a dynamic phenomenon, for example, a crystal ball, generally the components thereof present a unique dynamic phenomenon according to a predetermined driving structure.

In a further design of crystal decoration, the dynamic source thereof may drive a plurality of components simultaneously so that the decoration will present many dynamic phenomena at the same time, such as those disclosed in U.S. patent application Ser. No. 08/611,668.

However, though the structures of the aforementioned application may present many dynamic phenomena, too many components are required to match with the structures, and thus the manufacturing cost is not economical.

SUMMARY OF THE INVENTION

Accordingly, an improved structure has been disclosed by the inventor of the present invention, wherein a driving seat of a crystal ball, comprising a disk shape seat, a plurality of gears, a swing block, a restoring block, a rotary disk and other components; wherein the long hole of the extending arm of the swing block is located in the shaft of the driven gear, said driven gear is engaged with an active gear, and the gear on the lower end of the rotary disk is engaged with the active gear.

By said structure, when the active gear is rotated, said swing block is driven to rotate to swing forwards and backwards, and at the same time, said rotary disk will be driven to rotate.

The present invention will be better understood and its numerous objects and advantages will become apparent to those skilled in the art by reference to the following drawings in which:

DETAILED DESCRIPTION OF THE PREFERRED EMBODIMENT

Figure 1:
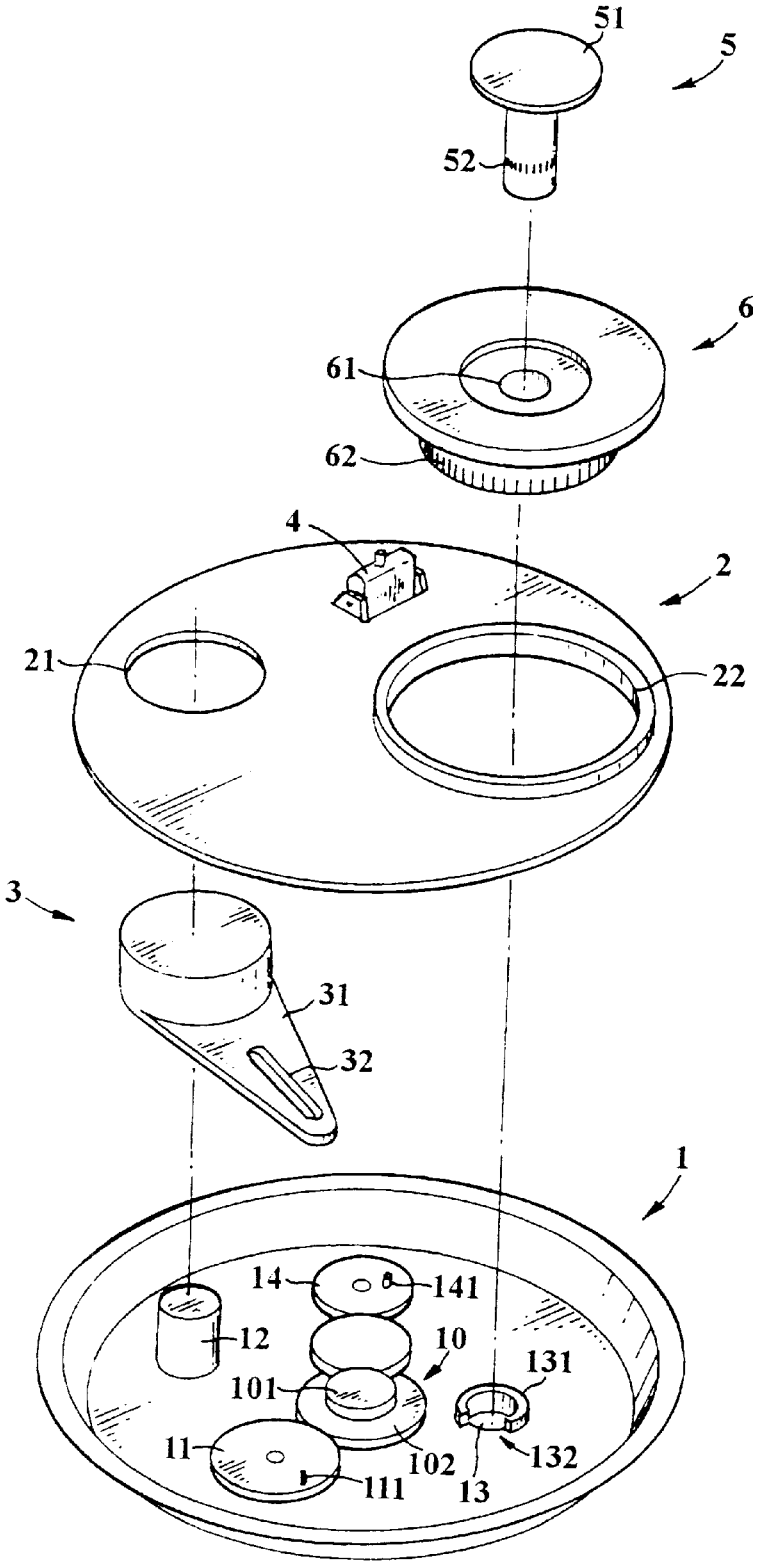
FIG. 1 is an exploded view of the driving seat of the present invention.
Figure 2:
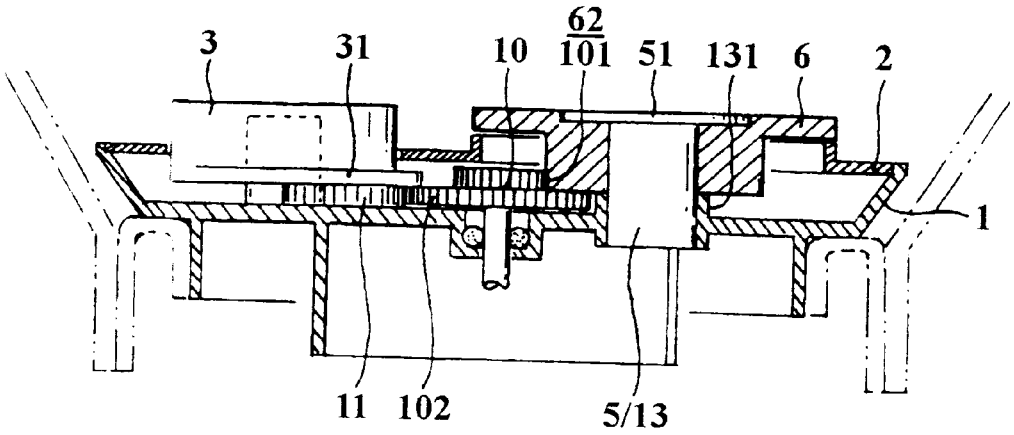
FIG. 2 is a front cross sectional view of FIG. 1.
Figure 3:
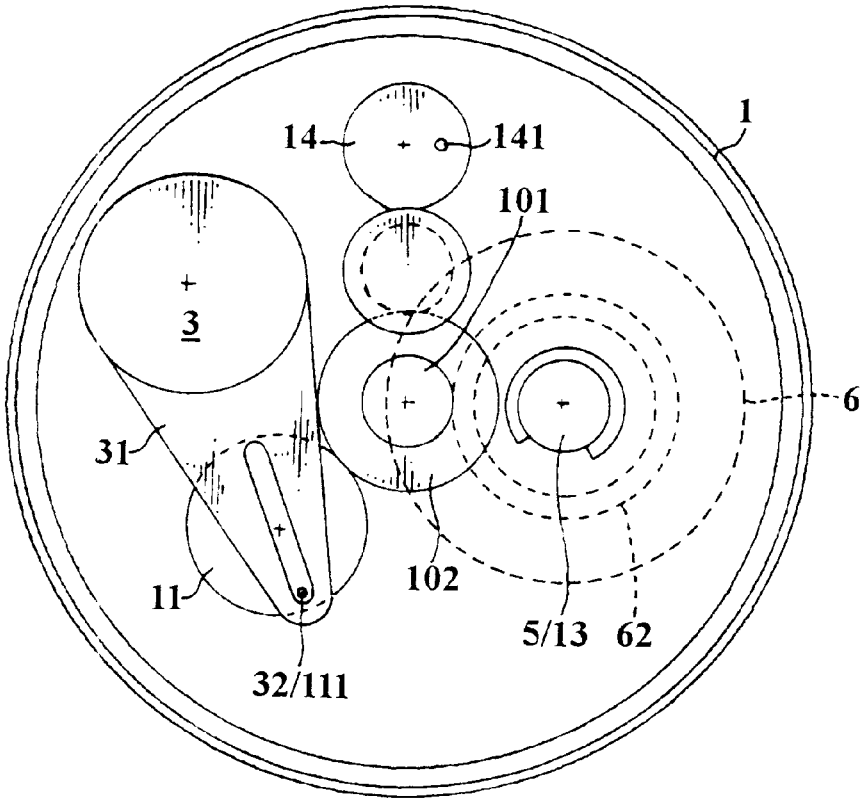
FIG. 3 is an overhead view corresponding to that in FIG. 1, wherein the upper cover has been removed.

The detailed description of the present invention is shown in FIGS. 1, 2 and 3.

The present invention is primarily comprised of a disk shape seat (1), a plurality of gears, a swing block (3), a restoring block (4), a rotary disk (6) and other components; wherein in the crystal ball decoration, said disk shape seat (1) is engaged on the lower end of the rubber plug seat of the crystal ball.

An active gear (10) is installed on the lower center of seat (1), which may be driven by a power source to present a rotary condition, and may be divided as an upper small gear (101) and a lower large gear (102).

Moreover, driven gears (11, 14) are installed on one side of said active gear (10), which are driven by the lower large gear (102) of said active gear (10), and two eccentric longitudinal shafts (111, 141) are installed on the upper surface of the driven gears (11, 14).

A cover (2) is installed on the upper surface of said seat (1) and a space is included between the cover (2) and the seat (1), and respective round holes (21, 22) are installed on the cover (2) with respect to the swing block (3) and the rotary disk (6); while a restoring block (4) is installed on the cover (2) with respect to said driven gear (14).

Said swing block (3) is engaged on the fixing shaft (12) on the proper position of the seat (1) so that the swing block may rotate according to the axial center of the fixing shaft (12), while the upper surface of said swing block (3) is penetrated through the cover round hole (21) to project from the upper end of the cover (2). An extending arm is horizontally extended from one side of the swing block (3) and a long hole (32) is formed on the extending arm (31) with respect to the shaft (111) of the driven gear (11).

By said structure, as the driven gear (11) and the active gear (10) are driven to rotate, the shaft (111) of the driven gear (11) will drive the swing block (3) to swing forwards and backwards according to the long hole (32) of the swing block (2).

If a proper decoration or doll is fixed on the upper surface of the swing block (3), then the decoration or doll will present a proper dynamic phenomenon.

An axial hole (61) is installed on the center of the rotary disk (6), a central axle (5) is penetrated through the axial hole (61) and the lower end of the central axle (5) is engaged on the fixing hole (13) of the seat (1) so that said rotary shaft (6) may rotate around the central axle (5) and a gear (62) is formed on the lower rim of said rotary disk (6), which is engaged with the small gear (101) on the upper end of the active gear (10).

By said structure, as the active gear (10) is rotated, the rotary disk (6) through the cover round hole (22) may be driven to rotate according to said gear (62).

If a proper decoration or doll is fixed on the upper portion of the rotary disk (6) and the central axle (5), then the decoration of the rotary disk (6) will present proper dynamic phenomenon around the decoration of the central axle (5).

Figure 4:
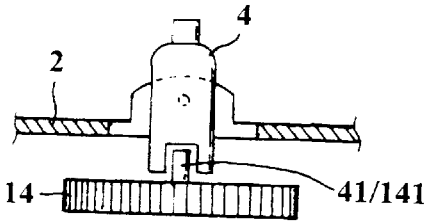
FIG. 4 is a partial cross sectional view of the restoring block with respect to the driven gear (14).
Figure 5:
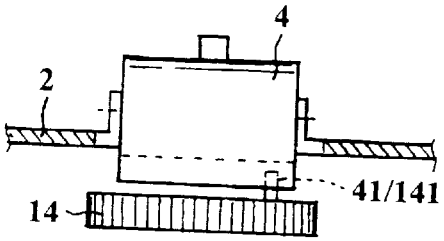
FIG. 5 is another side view of FIG. 4.

Moreover, a long strip restoring block (4) is installed on said cover (2) with respect to the driven gear (14), as shown in FIGS. 4 and 5, which is supported on a frame (20) of the cover (2) to present a swinging condition, while a long slot (41) with respect to the driven shaft (141) is formed on the lower end of the restoring block (4). Then as the driven gear (14) is driven by said active gear (10), said shaft (141) will drive the restoring block (4) to present a forward and backward swing with a different direction from that of said swing block (3).

Said swing block (3) and said restoring block (4) are driven by driven gears (11, 14), respectively. However, both of the two blocks are driven by the same method, thus as a modified embodiment of the present invention, said driven gear (14) may be substituted by said driven gear (11), that is, said restoring block (4) may be installed on the position of the driven gear shaft (111), then the driven gear (11) will drive the swing block (3) and the restoring block (4) simultaneously so as to swing forwards and backwards in different directions.

Figure 6:
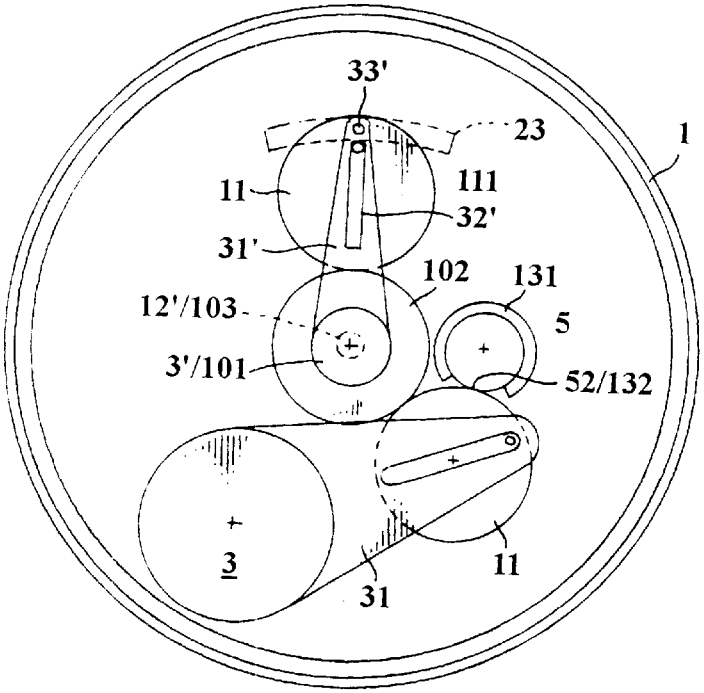
FIG. 6 is a modified embodiment of the present invention.
Figure 7:
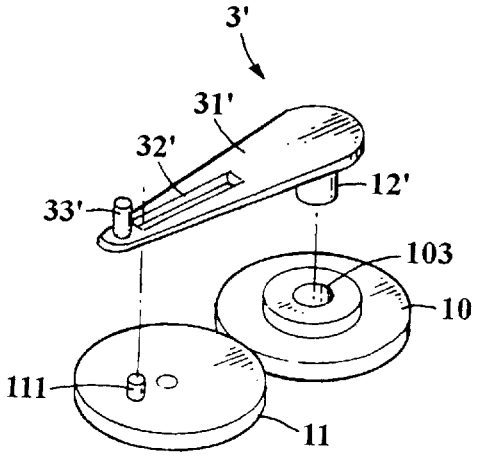
FIG. 7 is a modified embodiment of the swing block of the present invention.

FIGS. 6 and 7 show another modified embodiment as another swing condition of the present invention, wherein the shape of said swing block (3) is varied slightly. A fixing shaft (12') is installed on the lower end of the swing block (3'), and the fixing shaft (12') is engaged with an axial hole (103) installed on the center of the active gear (10) so that the swing block (3') is rotated around said fixing shaft (12'), and a fixing rod (33') projected from the cover (2) and with respect to a cambered slot (23) is installed on the end portion of the extending arm (31') of the swing block (3'). Therefore, as the driven gear (11) is driven to rotate, the shaft (111) thereof will push the swing block (3') to swing forwards and backwards according to the long round hole (32').

According to the structure of said embodiment, the present invention may be modified so as to present more plentiful dynamic phenomena, and the modified embodiments are described in the following:

A flange (131) with a predetermined height for supporting the rotary disk (6) is formed on the fixing hole (13) of the seat, and a notch (132) is formed on the proper range of the flange (131), as shown in FIGS. 1 and 6.

Furthermore, a gear (52) is formed on the central axle (5) with respect to the notch (132), so that the central axle (5) may rotate around the fixing hole (13).

Also, the horizontal height of the lower end of said rotary disk (6) is above the driven gear (11) so that the driven gear may pass though said notch (132) to engage with the gear (52) of the central axle (5). Thus when the driven gear (11) is driven to rotate by the active gear (10), said central axle (5) will be driven to rotate with a direction opposite to that of the rotary disk (6). That is, the decoration of the rotary disk (6) will present a proper dynamic phenomenon around the decoration of the central axle (5), which is now rotated in an opposite direction.

When the central axle (5) is driven by the driven gear (11), at the same time, said swing block (3) may sustain the predetermined action as that in said structure.

Although certain preferred embodiments of the present invention have been shown and described in detail, it should be understood that various changes and modifications may be made therein without departing from the scope of the appended claims.

What is claimed is:

1. A driving seat for a crystal ball, comprising:

a disk shaped seat having a base portion, a wall extending upwardly about a periphery of said base portion, and said base portion having a fixing hole defined therethrough;

a rotatable active gear positioned on the base portion of the disk shaped seat;

a first driven gear positioned on the base portion of the disk shaped seat and operatively engaged with the active gear, said first driven gear having an eccentric shaft extending from a first surface thereof;

a fixed shaft positioned on and extending upwardly from the base portion of the disk shaped seat;

a disk shaped cover supported on the wall of said seat and defining a space between the cover and the seat, said cover having a first hole and a second hole extending therethrough;

a swing block mounted on the fixed shaft, and movable about said shaft, an upper portion of said swing block extending through said first hole of said cover, said swing block having an arm extending therefrom, said arm having an elongated hole therethrough, said eccentric shaft of said first driven gear extending into said elongated hole to impart movement to said swing block;

a rotary disk having an axial hole extending therethrough, said rotary disk having a gear on a bottom surface thereof, said rotary disk supported within said second hole of said disk shaped cover with said gear on said rotary disk operatively engaged with said active gear on the base portion of said disk shaped seat; and a central axle having an upper surface portion, said central axle extending through said axial hole in said rotary disk and into said fixing hole in said base portion, said upper surface portion of said central axle being supported by an upper surface of said rotary disk, whereby a rotation of said rotatable active gear imparts motion to said swing block, and to said rotary disk.

2. The driving seat according to claim 1, wherein the seat further comprises:

a second driven gear positioned on the base portion of the disk shaped seat and operatively engaged with the active gear, the second driven gear having an eccentric shaft extending from a first surface thereof;

a frame for receiving a restoring block provided on the cover;

a restoring block supported on the frame of the cover, the restoring block having an elongated slot defined on one surface thereof which receives the eccentric shaft of the second driven gear, so that when the second driven gear is rotated, the restoring block is reciprocatingly rotated about a shaft extending parallel to the cover.

3. The driving seat according to claim 2, wherein the active gear comprises:

a first gear portion; and a second gear portion coaxial with and larger than the first gear portion, wherein the first and second driven gears are operatively engaged with the second gear portion of the active gear, and the gear of the rotary disk is operatively engaged with the first gear portion of the active gear.

4. The driving seat according to claim 3, wherein an axial portion of the central axle has an axle gear; and a flange is formed about the fixing hole of the seat, the flange having a notch defined at a portion thereof, said notch allows the first driven gear to engage the axle gear of the central axle.

5. The driving seat according to claim 2, wherein an axial portion of the central axle has an axle gear; and a flange is formed about the fixing hole of the seat, the flange having a notch defined at a portion thereof, said notch allows the first driven gear to engage the axle gear of the central axle.

6. The driving seat according to claim 1, wherein the active gear comprises:

a first gear portion; and a second gear portion coaxial with and larger than the first gear portion, wherein the first driven gear is operatively engaged with the second gear portion of the active gear, and the gear of the rotary disk is operatively engaged with the first gear portion of the active gear.

7. The driving seat according to claim 6, wherein an axial portion of the central axle has an axle gear; and a flange is formed about the fixing hole of the seat, the flange having a notch defined at a portion thereof, said notch allows the first driven gear to engage the axle gear f the central axle.

8. The driving seat according to claim 1, wherein an axial portion of the central axle has an axle gear; and a flange is formed about the fixing hole of the seat, the flange having a notch defined at a portion thereof, said notch allows the first driven gear to engage the axle gear of the central axle.

9. A driving seat for a crystal ball, comprising:

a disk shaped seat having a base portion, a wall extending upwardly about the base portion, and a fixing hole defined through the base portion;

a rotatable active gear positioned on the base portion of the disk shaped seat, the active gear having an axial hole defined in a center thereof;

a first driven gear positioned on the base portion of the disk shaped seat and operatively engaged with the active gear, said first driven gear having an eccentric shaft extending from a first surface thereof;

a second driven gear positioned on the base portion of the disk shaped seat and operatively engaged with the active gear, said second driven gear having an eccentric shaft extending from a first surface thereof;

a disk shaped cover installed on the wall of said seat defining a space between the cover and the seat, said cover having a first round hole, a second round hole, and a cambered slot extending therethrough;

a first swing block, having a first fixing shaft received in the axial hole of the active gear and rotatable with respect to the active gear, and a first extending arm extending from the first fixing shaft of the first swing block, wherein the extending arm has a first elongated hole defined therein receiving the eccentric shaft of the first driven gear, the first extending arm further having a fixing rod projecting from a first surface thereof, the fixing rod being received in the cambered slot of the cover so that when the first driven gear is rotated, it will drive the first extending arm of the first swing block to swing arcuately along the cambered slot of the cover while the first fixing shaft rotationally moves about the axial hole of the active gear;

a second fixing shaft positioned on the base portion of the disk shaped seat and extending upwardly from the base portion of the disk shaped seat;

a second swing block, having a base member engaged with the second fixing shaft which extends into the first round hole of the cover, the base member being rotatable about the second fixing shaft;

a second extending arm extending from the base member of the second swing block, the second extending arm having a second elongated hole defined therethrough, the second elongated hole receiving the eccentric shaft of the second driven gear, so that when the second driven gear is rotated, this rotation drives the second extending arm of the second swing block to swing clockwise and counterclockwise while the base member rotationally moves clockwise and counterclockwise about the second fixing shaft;

a rotary disk having an axial hole defined therethrough, said rotary disk having a gear on a bottom surface thereof, said rotary disk supported within said second hole of said disk shaped seat, said gear on the bottom surface of said rotary disk operatively engaged with said active gear on the base portion of said disk shaped seat; and a central axle having a surface portion, said central axle extending through said axial hole in said rotary disk and into said fixing hole in said base portion, said upper surface portion of said central axle being supported by an upper surface of said rotary disk, whereby rotation of said rotatable active gear imparts motion to said swing block, and to said rotary disk.

10. The driving seat according to claim 9, wherein an axial portion of the central axle includes an axle gear, wherein the axle gear is engaged with the active gear so that rotation of the active gear rotates the central axle.

11. A driving seat for a crystal ball, comprising:

a disk shaped seat having a base portion and a wall extending upwardly from said base portion;

a rotatable active gear positioned on the base portion of the disk shaped seat, said active gear having an axial hole defined in a center thereof;

a first driven gear operatively positioned on the base portion of the disk shaped seat and operatively engaged with the active gear, the first driven gear having an eccentric shaft extending from a first surface thereof;

a second driven gear, positioned on the base portion of the disk shaped seat and operatively engaged with the active gear, the second driven gear having an eccentric shaft extending from a first surface thereof;

a disk shaped cover, installed on the wall of the seat so that a space is defined between the cover and the seat, the cover having a first round hole and a cambered slot defined therein;

a first swing block having a first fixing shaft received in the axial hole of the active gear so that the first fixing shaft of the first swing block is rotatable with respect to the active gear, and a first extending arm extending from the first fixing shaft of the first swing block, and having a first elongated hole defined therein, the first elongated hole receiving the eccentric shaft of the first driven gear, the first extending arm further having a fixing rod projecting from a first surface thereof, said fixing rod being received in the cambered slot of the cover, so that when the first driven gear is rotated, it will drive the first extending arm of the first swing block to swing arcuately along the cambered slot of the cover, while the first fixing shaft rotationally moves clockwise and counterclockwise about the axial hole of the active gear;

a second fixing shaft positioned on the base portion of the disk shaped seat and extending upwardly therefrom; and a second swing block having a base member mounted on the second fixing shaft which extends into the first round hole of the cover, the base member being rotatable about the second fixing shaft, said second swing block further having a second extending arm extending from the base member of the second swing block, the second extending arm having a second elongated hole defined therein which receives the eccentric shaft of the second driven gear so that when the second driven gear is rotated, the second extending arm of the second swing block swings clockwise and counterclockwise while the base member rotationally moves clockwise and counterclockwise about the second fixing shaft.

12. A driving seat for a crystal ball, comprising:

a disk shaped seat having a base portion and a wall extending upwardly from the base portion;

a rotatable active gear positioned on the base portion of the disk shaped seat;

a first driven gear positioned on the base portion of the disk shape seat and operatively engaged with the active gear, said first driven gear having an eccentric shaft extending from a first surface thereof;

a fixed shaft mounted on the base portion of the disk shaped seat and extending upwardly from the base portion of said disk shaped seat;

a disk shaped cover installed on the wall of said seat defining a space between said cover and said seat, said cover having a first hole and a second hole defined therethrough;

a swing block having a base member which is mounted on the fixed shaft and which extends into the first hole of said cover, said base member being rotatable about the fixed shaft, said swing block further having an extending arm extending from the base member of the swing block, said arm having an elongated hole defined therein which receives the eccentric shaft of the first driven gear, so that when the first driven gear is rotated, the extending arm of the swing block swings clockwise and counterclockwise while the base member rotationally moves clockwise and counterclockwise about the fixed shaft; and a rotary disk having an axial hole extending therethrough, said rotary disk having a gear on a bottom surface thereof, said rotary disk supported within said second hole of said disk shaped seat, said gear on the bottom surface of said rotary disk operatively engaged with said active gear on the base portion of said disk shaped seat.

13. A driving seat for a crystal ball, comprising:

a disk shaped seat having a base portion and a wall extending upwardly from the base portion;

a rotatable active gear positioned on the base portion of said disk shaped seat;

a first driven gear positioned on the base portion of said disk shaped seat and operatively engaged with the active gear, the first driven gear having an eccentric shaft extending from a first surface thereof;

a fixed shaft positioned on the base portion of the disk shaped seat and extending upwardly therefrom;

a disk shaped cover installed on the wall of said seat defining a space between said cover and said seat, said cover having a first hole and a second hole therethrough;

a swing block having a base member mounted on the fixed shaft which extends into the first hole of the cover, the base member being rotatable about the fixed shaft, said swing block further having an extending arm extending from the base member of the swing block, the arm having an elongated hole defined therein which receives the eccentric shaft of the first driven gear so that when the first driven gear is rotated, the extending arm of the swing block swings clockwise and counterclockwise while the base member rotationally moves clockwise and counterclockwise about the fixed shaft;

a second driven gear positioned on the base portion of the disk shaped seat and operatively engaged with the active gear, the second driven gear having an eccentric shaft extending from a first surface thereof;

a frame for receiving a strip restoring block provided on the cover; and, a strip restoring block supported on the frame of the cover having an elongated slot defined on one surface thereof which receives the eccentric shaft of the second driven gear, so that when the second driven gear is rotated, the restoring block is reciprocatingly rotated about a shaft extending parallel to the cover.

14. A driving seat of a crystal ball, comprising:

a disk shaped seat having a base portion, a wall portion extending upwardly from said base portion, and a fixing hole defined therethrough;

a disk shaped cover on the wall portion of said disk shaped seat and defining a space between said cover and said seat, said cover having a first hole and a second hole defined therethrough;

a rotatable active gear positioned on said disk shaped seat;

driven gears positioned on said disk shaped seat and operatively engaged with said active gear, upper surfaces of said driven gears having eccentric longitudinal shafts extending upwardly therefrom;

a fixing shaft extending upwardly from the disk shaped seat;

a swing block having a base member and an extending arm, said base member rotatably mounted on the fixing shaft and extending upwardly through said first hole of said cover, said extending arm having a longitudinal hole defined therethrough, said eccentric longitudinal shaft of one of said driven gears extending into said elongated hole to impart movement to said swing block when said driven gears are rotated; and a rotary disk having an axial hole extending therethrough, said rotary disk having a gear on a bottom surface thereof, said rotary disk supported in said second hole of said disk shaped cover with said gear on said rotary disk, and operatively engaged with said active gear on said base portion of said disk shaped seat;

a central axle having an upper surface portion, said central axle extending through said axial hole in said rotary disk and into said fixing hole in said base portion of said seat, said upper surface portion of said central axle being supported by an upper surface of said rotary disk; and a flange formed about said fixing hole of said seat, said flange having a notch defined at a portion thereof.

15. A driving seat of a crystal ball according to claim 14, wherein a gear is formed on the central axle with respect to the notch.

16. The driving seat of a crystal ball according to claim 15, wherein the gear of the central axle is engaged with a driven gear at said notch.

* * * * *